US009653047B2

(12) United States Patent
Chen

(10) Patent No.: US 9,653,047 B2
(45) Date of Patent: May 16, 2017

(54) FINGER-PRESSED AUXILIARY DEVICE FOR A STRINGED INSTRUMENT

(71) Applicant: Tsung-Jung Chen, New Taipei (TW)

(72) Inventor: Tsung-Jung Chen, New Taipei (TW)

( * ) Notice: Subject to any disclaimer, the term of this patent is extended or adjusted under 35 U.S.C. 154(b) by 0 days.

(21) Appl. No.: 14/867,120

(22) Filed: Sep. 28, 2015

(65) Prior Publication Data

US 2017/0092239 A1 Mar. 30, 2017

(51) Int. Cl.
*G10D 1/08* (2006.01)
*G10D 3/06* (2006.01)

(52) U.S. Cl.
CPC ..... *G10D 3/06* (2013.01)

(58) Field of Classification Search
CPC ..... G10D 3/06
USPC ..... 84/314 R
See application file for complete search history.

(56) References Cited

U.S. PATENT DOCUMENTS

| | | | | | |
|---|---|---|---|---|---|
| 2,132,281 | A | | 10/1938 | Adamson | 84/317 |
| 2,744,433 | A | | 5/1956 | Rooms | 84/315 |
| 3,568,560 | A | | 3/1971 | Chang | 84/317 |
| 3,682,036 | A | | 8/1972 | Null | 84/317 |
| 3,776,088 | A | | 12/1973 | Jones | 84/317 |
| 3,818,793 | A | * | 6/1974 | Round | G10D 3/00 84/454 |
| 3,837,255 | A | | 9/1974 | Starns | 84/317 |
| 3,915,051 | A | | 10/1975 | Kincaid | 84/317 |
| 3,995,523 | A | | 12/1976 | Clarke | 84/317 |
| 4,030,400 | A | | 6/1977 | Del Castillo | 84/317 |
| 4,061,069 | A | | 12/1977 | Brackett | 84/315 |
| 4,154,134 | A | | 5/1979 | Schreiber | 84/317 |
| 4,204,454 | A | | 5/1980 | Severn | 84/315 |
| 4,289,057 | A | * | 9/1981 | Whitlock | G09B 15/006 84/473 |
| 4,331,059 | A | | 5/1982 | Marabotto | 84/317 |
| 4,417,497 | A | * | 11/1983 | Nicklaus | G09B 15/06 84/476 |
| 4,428,273 | A | | 1/1984 | Favron | 84/317 |
| 4,545,281 | A | | 10/1985 | Habicht | 84/315 |

(Continued)

FOREIGN PATENT DOCUMENTS

| | | |
|---|---|---|
| CN | 102163424 A | 8/2011 |
| TW | M304737 | 1/2007 |

OTHER PUBLICATIONS

Office Action 104134617, Sep. 23, 2016, TW.
Search Report 104134617, Sep. 23, 2016, TW.

*Primary Examiner* — Jianchun Qin
(74) *Attorney, Agent, or Firm* — Bui Garcia-Zamor; Jessica H. Bui, Esq.

(57) ABSTRACT

A finger-pressed auxiliary device for a stringed instrument is provided. The stringed instrument comprises a body, a neck connected to the body, a fingerboard disposed on the neck, a plurality of frets disposed on the fingerboard at spaced intervals, and a plurality of strings extending along the length direction of the neck. The finger-pressed auxiliary device comprises: a plurality of finger-pressed plates extending along the length direction of the strings and each being disposed to correspond to a respective string; an upper support secured to the top of the neck; and a lower support secured to the bottom of the neck or the body. As the fingers only have to contact the surfaces of the finger-pressed plates, the pain associated with holding strings with fingertips is avoided.

14 Claims, 5 Drawing Sheets

(56) References Cited

U.S. PATENT DOCUMENTS

| | | | | | |
|---|---|---|---|---|---|
| 4,545,282 | A | | 10/1985 | Arnett | 84/317 |
| 4,566,365 | A | | 1/1986 | Huston | 84/317 |
| 4,593,595 | A | | 6/1986 | Rand | 84/317 |
| 4,602,550 | A | * | 7/1986 | Dadi | G09B 15/006 84/473 |
| 4,622,880 | A | | 11/1986 | Glemming | 84/317 |
| 4,665,789 | A | | 5/1987 | Papadatos | 84/317 |
| 4,796,506 | A | * | 1/1989 | Gray | G10D 3/04 84/317 |
| 5,831,189 | A | | 11/1998 | Edlund | 84/315 |
| 6,452,081 | B1 | | 9/2002 | Ravagni et al. | 84/477 R |
| 6,753,466 | B1 | | 6/2004 | Lee | 84/669 |
| 6,998,526 | B1 | * | 2/2006 | Sims | G10D 3/043 84/318 |
| 7,075,001 | B2 | | 7/2006 | Williams | 84/745 |
| 7,304,224 | B1 | | 12/2007 | Bettis | 84/293 |
| 7,468,478 | B2 | | 12/2008 | Davis | 84/290 |
| 7,812,233 | B1 | | 10/2010 | Lee | 84/317 |
| 7,875,786 | B2 | * | 1/2011 | Hammond | G09B 15/02 84/477 R |
| D669,117 | S | | 10/2012 | De Neufville | D17/20 |
| 8,319,082 | B1 | | 11/2012 | Bacon | 84/314 R |
| 8,835,731 | B1 | | 9/2014 | Perry | 84/317 |
| 8,878,035 | B2 | | 11/2014 | Stenbroten | 84/318 |
| 9,076,413 | B2 | | 7/2015 | Krumwiede | G10D 3/16 |
| 9,135,896 | B2 | | 9/2015 | Rozendaal | 84/317 |
| 2007/0034070 | A1 | | 2/2007 | Hammond | 84/477 |
| 2013/0023772 | A1 | | 1/2013 | Kinsley et al. | 600/474 |
| 2013/0239772 | A1 | | 9/2013 | Perry | 84/470 |

* cited by examiner

FINGER-PRESSED AUXILIARY DEVICE FOR A STRINGED INSTRUMENT

BACKGROUND OF THE INVENTION

Field of the Invention

The present invention relates to a finger-pressed auxiliary device for a stringed instrument, and more particularly, a finger-pressed auxiliary device which can avoid the pain associated with holding strings with fingertips by using a finger-pressed plate.

Description of the Related Art

In an ideal case, fingering the strings at a position closer to a fret would produce a beautiful tone without having to apply too much force (as shown in FIG. 16). However, such ideal finger placement position for a chord is not possible in view of the finger arrangement as far as ergonomics is concerned. As shown in FIG. 16*a*, since the finger placement position ① for A chord is farther away from the frets, more strength is needed to produce a normal tone. As a result, finger tip pain occurs when depressing the string.

Various mechanisms have been developed to help the beginner user to reduce pain caused by depressing the strings. For example, Taiwan Utility Model Patent No. M304737 issued to the present inventor provides a learning auxiliary device for a guitar. Furthermore, US Patent Published Application No. 2007/0034070 provides an instructional method and device for illustrating note positions in combinations corresponding to chords formed on a stringed instrument. Also, US Patent Published Application No. 2013/0239772 provides a chord playing attachment and related methods.

The above published documents all provide an auxiliary device for practicing chords. Basically, strings are depressed with the aid of an auxiliary device only for a localized region corresponding to certain particular notes and finger placement positions. However, in addition to chords, more notes and various finger placement positions are needed for a skill play. Therefore, the beginner still needs to depress the strings with his/her own fingers, and finger tip pain occurs as a result of depressing the strings.

SUMMARY OF THE INVENTION

A primary object of the present invention is to provide a finger-pressed auxiliary device for a stringed instrument, which can avoid the pain associated with holding strings with fingertips by means of a finger-pressed plate, so as to improve the traditional stringed instrument.

To achieve the above object and other objects, a finger-pressed auxiliary device for a stringed instrument according to the present invention is provided. The stringed instrument comprises: a neck connected with a body, a fingerboard disposed on the neck, a plurality of frets partitioning the fingerboard laterally; and a plurality of strings, extending along the length direction of the neck. The finger-pressed auxiliary device comprises: a plurality of finger-pressed plates extending along the length direction of the neck, each disposed to correspond to a respective sting; an upper support secured to the top of the neck and supports one ends of the finger-pressed plates in suspension, and a lower support secured to the bottom of the neck or the body, and supports the other ends of the finger-pressed plates in suspension.

The bottom surface of each finger-pressed plate is provided with a plurality of transverse ribs. When one of the finger-pressed plates is pressed, one of the plurality of transverse ribs on the bottom surface of the one of the finger-pressed plate will depress the corresponding string against the fingerboard. When the finger-pressed plates are not pressed, the finger-pressed plates do not touch the strings.

According to the present invention, the upper support comprises a cross bar, the right and left sides of which are supported by a pair of support brackets so as to form a receiving portion between the two support brackets. One ends of the plurality of finger-pressed plates are received in the receiving portion and secured under the bottom surface of the cross bar in equidistance.

Furthermore, the lower support comprises a cross bar, the right and left sides of which are supported by a pair of support brackets so as to form a receiving portion between the two support brackets. The other ends of the plurality of finger-pressed plate are received in the receiving portion and secured under the bottom surface of the cross bar in equidistance.

Preferably, the finger-pressed auxiliary device is removably installed on the fingerboard with the strings located under the device. The width of each finger-pressed plate is at least two times larger than the diameter of the string.

Also, the top surface of each finger-pressed plate is planar. Preferably, the top surface of each finger-pressed plate is shaped into a convex surface or a concave surface.

Preferably, a plurality of partitioning lines corresponding to the plurality of frets of the fingerboard is provided on the top surface of each finger-pressed plate. The plurality of ribs of each finger-pressed plate corresponds to the plurality of frets, respectively and is staggered with the plurality of frets. The string-pressing face of each rib is formed with a groove corresponding to the string, so that a force exerted by a fingertip of a user can be precisely transferred to the string via the finger-pressed plate, and the finger-pressed plate can not slip off the string.

Preferably, the plurality of finger-pressed plates are formed in one piece with both ends thereof serve as fixed ends. The one-piece finger-pressed plate is cut into a plurality of finger-pressed plate units by a plurality of cutting lines for easy production, assembly, and fixation.

Moreover, the present invention provides an upper support comprising a nut block. One end of the nut block is a fixed end and is fixed to the top of the neck laterally. On the nut block, a plurality of longitudinal grooves is disposed at the positions corresponding to the plurality of stings and extends downwards from the top surface to receive the strings so that a single string extends through each corresponding groove. The other end of the nut block is formed with a protrusion which is protruded and inclined with respect to the length direction of the strings. On the protrusion, a plurality of longitudinal recesses that extend over both sides of the grooves are disposed on the protrusions at positions corresponding to the plurality of grooves for supporting each finger-pressed plate. In this way, each finger-pressed plate can precisely correspond to each string.

Also, the present invention provides a lower support comprising an upper clamp, a lower clamp, a clamping pate, and a stopping part. The upper clamp has a cross-sectional shape of an inverted "U" and crosses above the fingerboard, the both ends of the upper clamp are provided with a pair of connecting part, and a supporting part is formed on the bottom surface between the both ends of the upper clamp for supporting the other ends of the plurality of finger-pressed plate. The lower clamp has a U-shaped cross section and surrounds the neck, and the both ends of the lower clamp are provided with a pair of connecting part. The clamping plate is pressed against the fingerboard, and the both ends of the clamping plate are located between the connecting parts of the upper clamp and the lower clamp and they are fixed to each other by fasteners. The stopping part comprises a limiting plate and a bolt. The limiting plate is located on the inside of the lower clamp and under the neck. The lower clamp is provided with a threaded hole correspondingly. One end of the bolt is pushed through the threaded hole to abut against the limiting plate, and the other end of the bolt is provided with a rotary handle which is on the outside of the lower clamp. When the rotary handle is turned and moved toward the threaded hole, a clamping force can be generated between the limiting plate and the clamping plate to fasten the lower support on the neck, so that the device is adapted to a variety of stringed instruments.

Additionally, the present invention provides a light-emitting indicating device, wherein light-emitting units are used on corresponding finger position regions of the finger-pressed plates to indicate the finger positions of a chord in an individual key by emitting lights. In this way, for the beginner, the leaning efficiency can be promoted fast without keeping the chords in different keys in mind.

DESCRIPTION OF THE PREFERRED EMBODIMENTS

Figure 1:
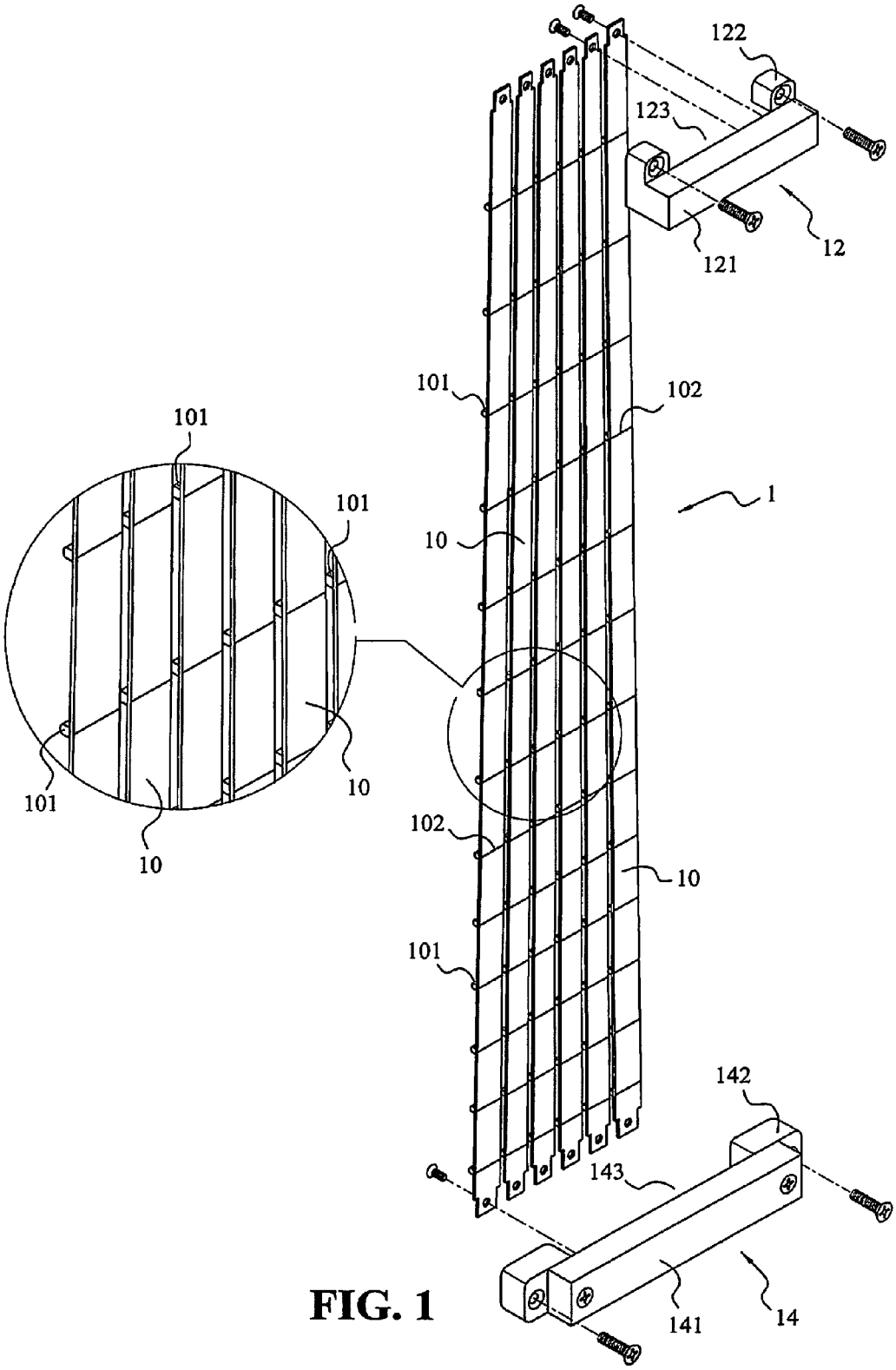
FIG. 1 is an exploded view showing a finger-pressed auxiliary device for a stringed instrument according to the present invention.
Figure 2:
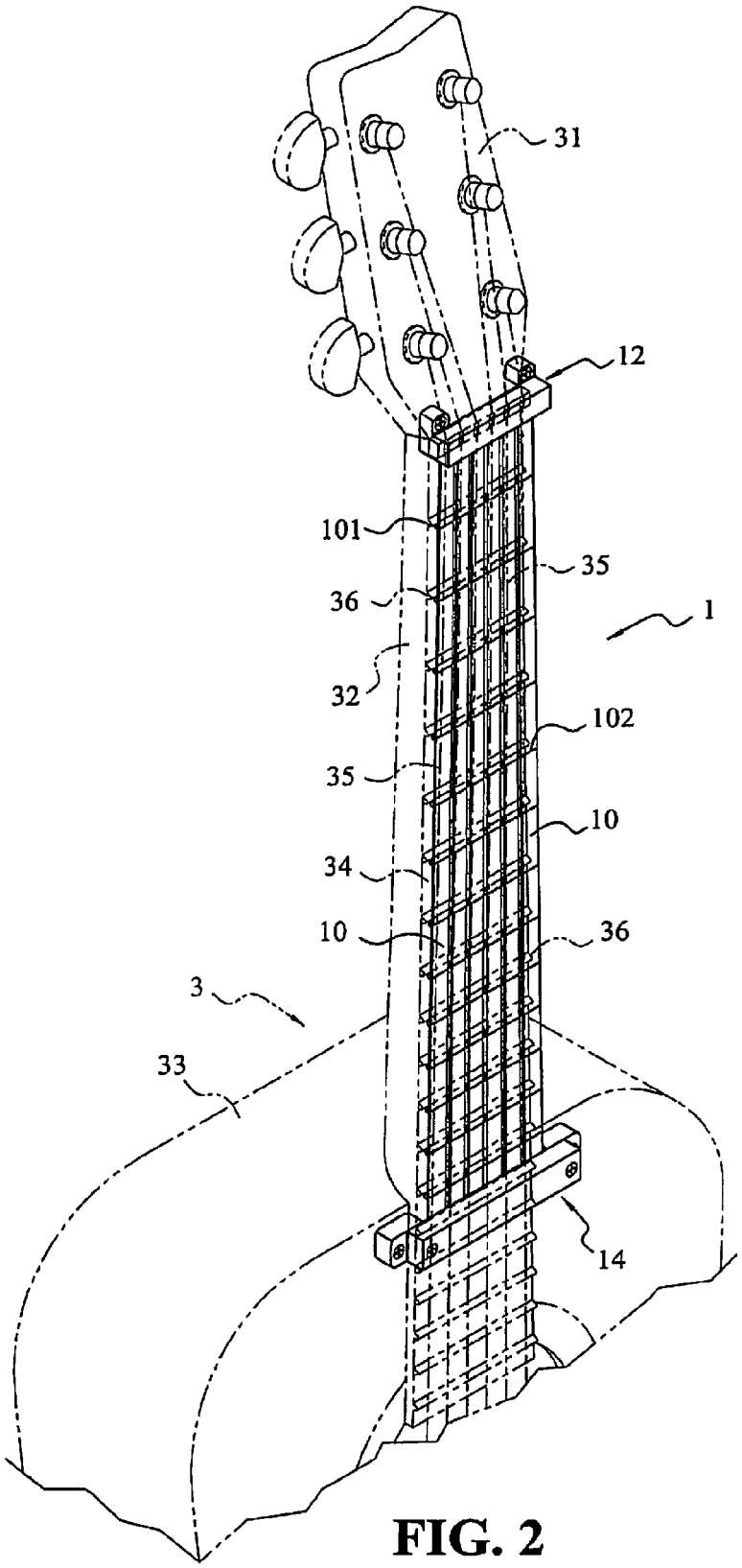
FIG. 2 is a perspective view showing a stringed instrument having the finger-pressed auxiliary device of the present invention installed, in an assembly state, wherein a portion of the string instrument is shown in section.
Figure 3:
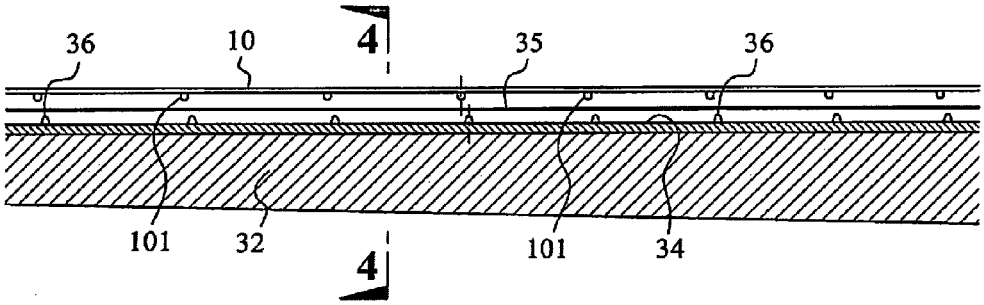
FIG. 3 is a partial longitudinal sectional view showing the neck of a stringed instrument having the finger-pressed auxiliary device of the present invention installed.

The technical features of the present invention will become more apparent by the descriptions of the following embodiments in conjunction with accompanying drawings. FIG. 1 shows a finger-pressed auxiliary device for a stringed instrument according to the first embodiment of the present invention in exploded view. FIG. 2 shows a stringed instrument having the finger-pressed auxiliary device installed, in an assembly state. A conventional guitar will be taken as an example for the description of the stringed instrument in the figures.

As shown in the figures, a guitar 3 comprises a head 31; a neck 32 extending longitudinally from the head 31; and a body 33 connected to one end of the neck 32. The body 33 is a resonance box consisting of a front plate, a side plate, a rear plate, and a fingerboard 34 disposed on the top surface of the neck 32. A plurality of strings 35 arranged in the order of thickness extends longitudinally at the neck 32. One end of each string is secured on the lower saddle of the body 33, the other end of the strings extends over an upper saddle (no shown in the figure) located between the neck 32 and the head 31. Each of the strings 35 is tensioned by the tuning peg on the head 31. A plurality of frets 36 spaced at intervals is provided to partition the fingerboard 34 into a plurality of columns.

The finger-pressed auxiliary device 1 for a stringed instrument according to the present invention comprises a plurality of finger-pressed plates 10, which is flaky and flexible. Each finger-pressed plate 10 is located just above each string 35 and extends along the length direction thereof. The bottom surface of each finger-pressed plate 10 is provided with a plurality of transverse rib 101 corresponding to the plurality of frets 36.

The finger-pressed auxiliary device 1 further comprises an upper support 12. The upper support 12 includes a cross bar 121, the right and left sides of which are supported by a pair of support brackets 122 in suspension. The two support brackets 122 are secured to the top of the neck 32, and a receiving portion 123 is formed between the two support brackets 122. The finger-pressed plates 10 are received in the receiving portion 123 at one end, and secured beneath the bottom surface of the cross bar 121 by means of fasteners.

The finger-pressed auxiliary device 1 also comprises a lower support 14. The lower support 14 includes a cross bar 141, the right and left sides of which are supported by a pair of support brackets 142 in suspension. The two support brackets 142 are secured to the body 33, and a receiving portion 143 is formed between the two support brackets 142. The finger-pressed plates 10 are received in the receiving portion 143 of the lower support 14 at the other end, and secured beneath the bottom surface of the cross bar 141 by means of fasteners.

Moreover, a plurality of partitioning lines 102 is provided on the top surface of each finger-pressed plate 10 and corresponds to the plurality of frets 36 of the fingerboard 34. The finger-pressed auxiliary device 1 is removably installed on the fingerboard 34 with the strings 35 located under the device. Preferably, the width of each finger-pressed plate 10 is at least two times larger than the diameter of the corresponding string 35.

Figure 4:
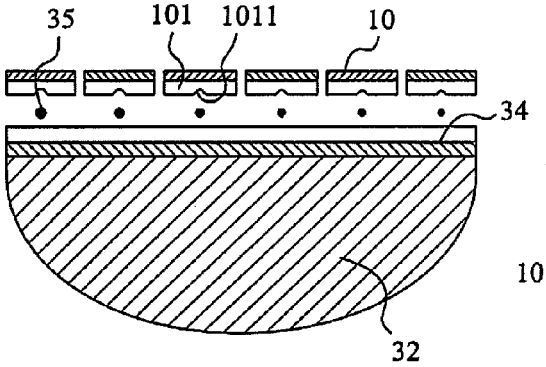
FIG. 4 schematically shows a transverse sectional view taken along line 4-4 of FIG. 3.
Figure 4A:
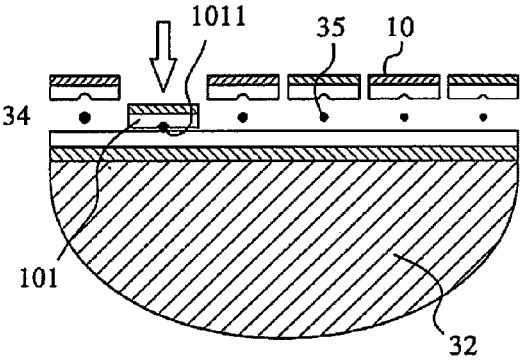
FIG. 4*a* shows a sectional view similar to FIG. 4 with a string being depressed.
Figure 5:
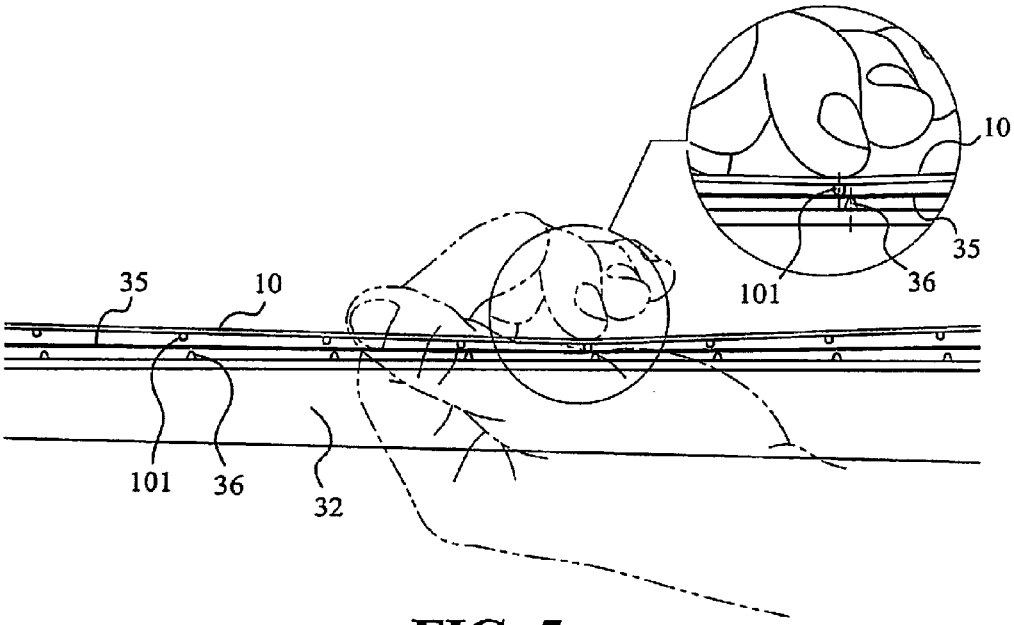
FIG. 5 is a schematic view showing the state of fingering the strings by means of the finger-pressed auxiliary device.

FIGS. 3, 4, 4*a*, and 5 are longitudinal sectional view, transverse sectional view, and view of state of use, respectively, showing the related members of the finger-pressed auxiliary device 1. According to the present invention, a plurality of ribs 101 of each finger-pressed plate 10 are arranged to correspond to and staggered with the plurality of frets 36, so that each rib 101 is slightly above each corresponding fret 36 (as shown in FIG. 5). Furthermore, the surface of the rib 101 of each finger-pressed plate 10 is formed with a groove 1011 corresponding to its respective string 35 (as shown in FIGS. 4 and 4*a*). In this way, a force exerted by a fingertip of a user can be precisely transferred to the string through the finger-pressed plate 10, and the finger-pressed plate 10 will not slip off the string 35.

Figure 7:
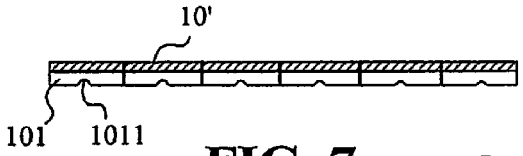
FIG. 7 is schematically shows a transverse sectional view of the finger-pressed plates of FIG. 6, wherein the top surface of the finger-pressed plate is shown as a quasi-plane.
Figure 6:
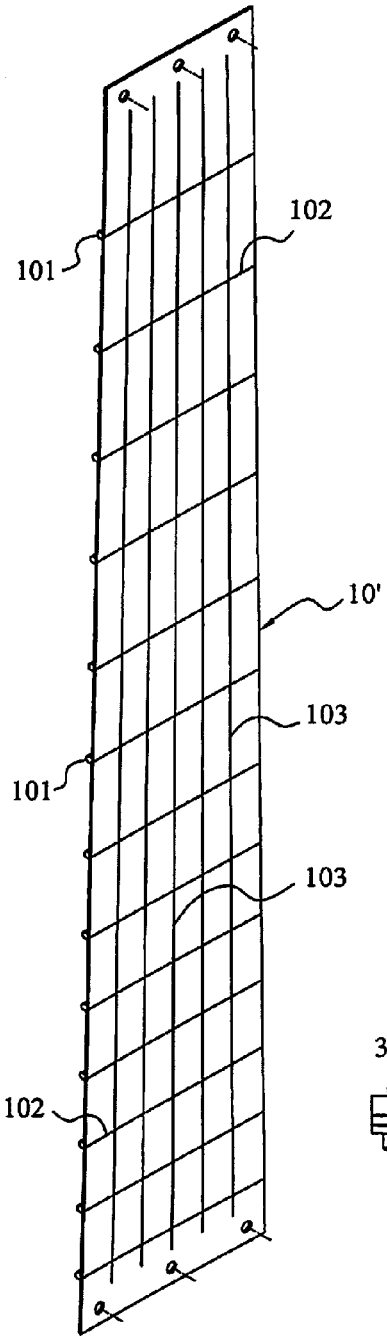
FIG. 6 is a perspective view showing the second embodiment of the finger-pressed plates of the finger-pressed auxiliary device of the present invention.

FIGS. 6 and 7 illustrate a second embodiment of the finger-pressed plate of the present invention. As shown in the figures, the top surface of the finger-pressed plate 10' is a quasi-plane. The finger-pressed plates are formed in one piece, and both ends arranged as fixed ends. The one-piece finger-pressed plate is cut and divided into a plurality of finger-pressed plate units 10' by a plurality of cutting lines 103 for easy production, assembly, and fixation.

Figure 8:
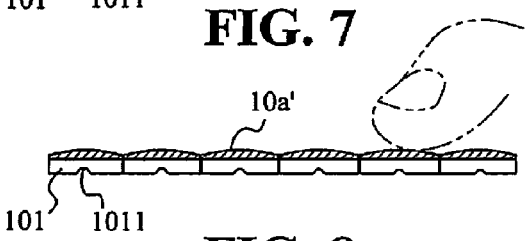
FIG. 8 is a transverse sectional view showing the third embodiment of the finger-pressed plates of the present invention, wherein the top surface of the finger-pressed plate is shown as a rounded convex.
Figure 9:
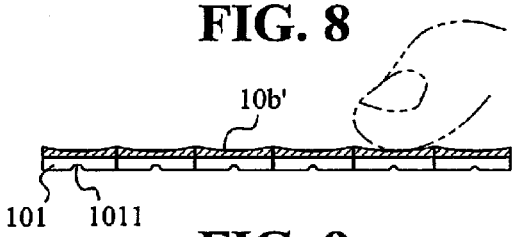
FIG. 9 is a transverse sectional view showing the fourth embodiment of the finger-pressed plates of the present invention, wherein the top surface of the finger-pressed plate is shown as a rounded concave.

FIG. 8 shows the third embodiment of the finger-pressed plates of the present invention. In particular, in the third embodiment, the top surface of the finger-pressed plate 10*a*' is formed as a rounded convex. FIG. 9 shows the fourth embodiment of the finger-pressed plates of the present invention. The fourth embodiment is different in that the top surface of each finger-pressed plate 10*b*' is formed as a rounded concave. In this way, a user can more precisely depress the string. The tactile sense is significantly improved when a user depresses the string, and a force exerted by a fingertip of the user can be precisely transferred to the string 35.

Figure 10:
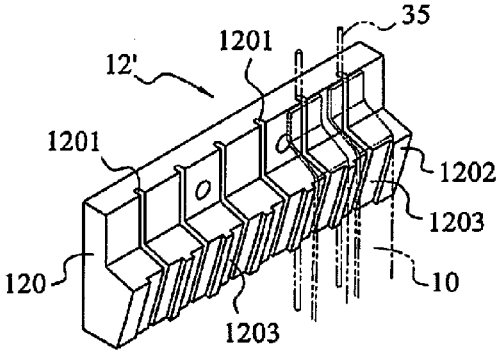
FIG. 10 is a perspective view showing the second embodiment of the upper support of the finger-pressed auxiliary device of the present invention.

FIG. 10 shows the second embodiment of the upper support provided by the present invention. As shown in the figure, the upper support 12' comprises a nut block 120. One end of the nut block 120 is fixed to the top of the neck laterally. The other end of the nut block 120 is formed with a protrusion 1202 which is inclined with respect to the length direction of the strings 35. On the nut block 120, each of the plurality of longitudinal grooves 1201 is positioned to correspond to each respective string 35, and extends downwardly from the top surface to receive the string so that a single string 35 extends through each corresponding groove 1201. On the protrusion 1202, each of the plurality of longitudinal recesses 1203 is positioned to correspond to each respective groove 1201, and each recess 1203 extends over both sides of the groove 1201 for supporting the finger-pressed plate 10. In this way, each finger-pressed plate 10 is precisely positioned to correspond to each respective string 35.

Figure 11:
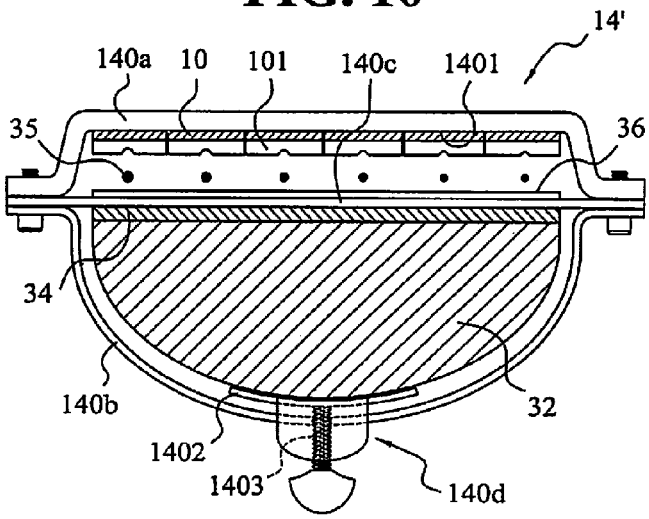
FIG. 11 is a transverse sectional view showing the second embodiment of the lower support of the finger-pressed auxiliary device of the present invention.

FIG. 11 shows the second embodiment of the lower support provided by the present invention. As shown in the figure, the lower support 14' comprises an upper clamp 140*a*, a lower clamp 140*b*, a clamping pate 140*c*, and a stopping part 140*d*. The upper clamp 140*a* has a cross-sectional shape of an inverted "U", and is disposed above the fingerboard 34 in suspension. The upper clamp 140*a* is provided with a connecting part at each end, and a supporting part 1401 is formed on the bottom face between both ends of the upper clamp 140*a* for supporting the other ends of the plurality of finger-pressed plates 10. The lower clamp 140*b* has a U-shaped cross-section and is attached to the periphery of the neck 32, and has a connecting part at each end thereof. The clamping plate 140*c* is pressed against the fingerboard 34, and is sandwiched between the connecting parts of the upper clamp 140*a* and the lower clamp 140*b*, and the ends of the clamping plate, the connecting parts of the upper and lower clamps are fastened together by fasteners. The stopping part 140*d* comprises a limiting plate 1402 and a bolt 1403. The limiting plate 1402 is located within the lower clamp 140*b* and beneath the neck 32. The lower clamp 140*b* is provided with a threaded hole through which one end of the bolt 1403 is extended to urge against the limiting plate 1402, and the other end of the bolt 1403 is provided with a handle which is disposed outside the lower clamp. When the handle is turned to advance the bolt 1403 toward the threaded hole, a clamping force can be generated between the limiting plate 1402 and the clamping plate 140*c* to urge the lower support 14' against the neck 32, so that the device is adapted to a variety of stringed instruments.

Accordingly, when a force is exerted on each finger-pressed plate, one of the plurality of ribs depresses a corresponding string against the fingerboard. However, when no force is exerted on the finger-pressed plates, the finger-pressed plates do not touch the strings. In this way, the point contact between a finger and a string is converted into a as the fingers only have to contact the surfaces of the finger-pressed plates, rather than making point contact with the strings, the pain associated with holding strings with fingertips is avoided.

Figure 12:
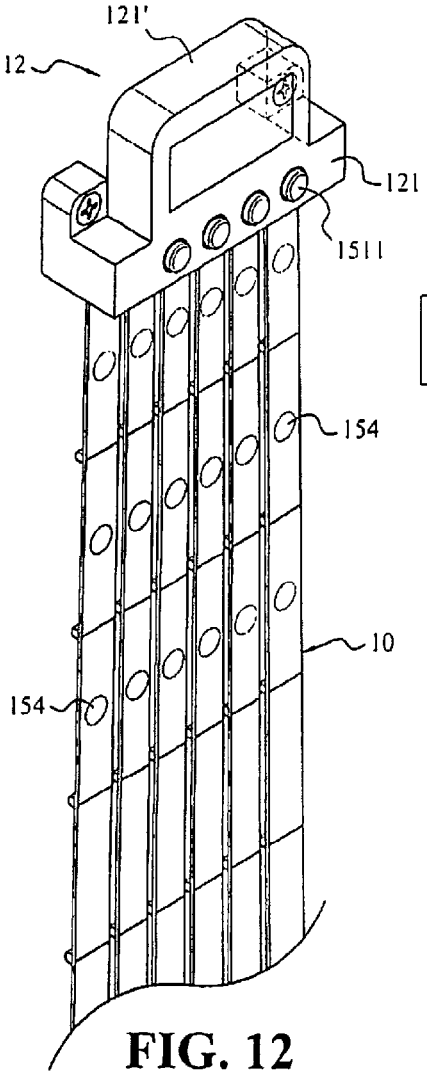
FIG. 12 is a perspective view showing the fifth embodiment of the finger-pressed plates of the present invention, wherein light-emitting units are disposed on some localized finger placement positions of the finger-pressed plates.
Figure 13:
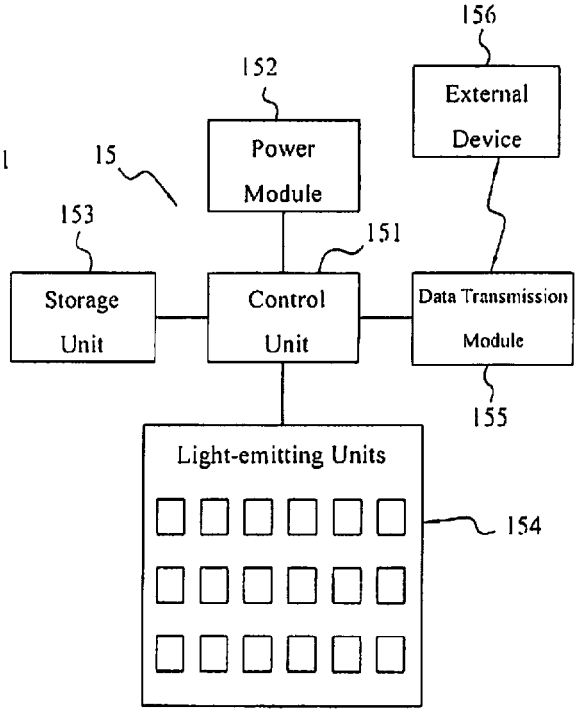
FIG. 13 is a block diagram showing the operation of the embodiment of FIG. 12.

Additionally, FIGS. 12 and 13 show the fifth embodiment of the finger-pressed plates of the present invention. The present embodiment further comprises a light-emitting indicating device 15. The light-emitting indicating device 15 includes a control unit 151 and a plurality of light-emitting units 154. The plurality of light-emitting units 154 are electrically connected to the control unit 151 and disposed on the specific finger placement positions of the finger-pressed plates 10. The control unit 151 controls the corresponding light-emitting units 154 to emit light based on the data of the finger placement positions playing a chord or note. Preferably, the light-emitting indicating device 15 is received in a space 121' of the upper support 12. The control unit 151 comprises at least a control button 1511 for opening or switching the data of the finger placement positions of chords in different keys. The plurality of light-emitting units 154 are for example, light and thin light-emitting diodes.

Furthermore, the light-emitting indicating device 15 comprises a power module 152, a storage unit 153, and a data transmission module 155. The power module 152, the storage unit 153, and the data transmission module 155 are electrically connected to the control unit 151. The power module 152 is for example, a storage battery. The storage unit 153 is used to store the data of the finger placement positions for at least a chord of a key. The data transmission module 155 can transmit or receive data via wire or wireless transmission, for example, USB or Bluetooth. Moreover, an external device, for example, mobile phone, tablet, personal computer (PC), and notebook (NB), can store the data of the finger placement positions for chords in different frequently used keys, such as keys of A-SB chords, in the storage unit 153 through the data transmission module 155.

Figure 14:
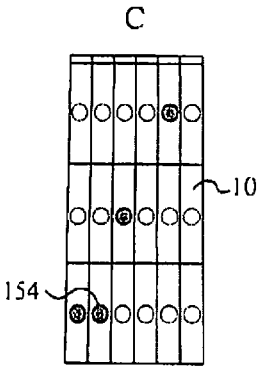
FIG. 14 is a schematic view showing the state of use of the embodiment of FIG. 12, wherein the light-emitting units corresponding to the finger positions of a chord in a specific key will emit lights.
Figure 15:
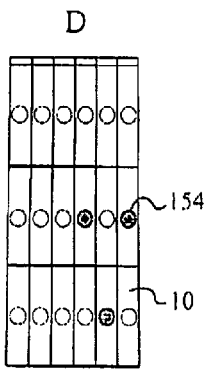
FIG. 15 is another use-state schematic view of the embodiment of FIG. 12, wherein the light-emitting units corresponding to the finger placement positions of a chord in different key will emit lights.
Figure 16:
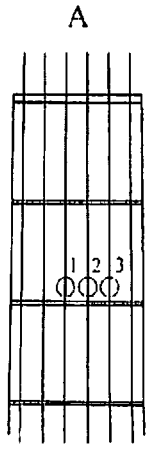
( PRIOR ART ) FIG. 16
FIG. 16 is a schematic view showing the ideal finger placement positions for A chord of prior art.
Figure 16A:
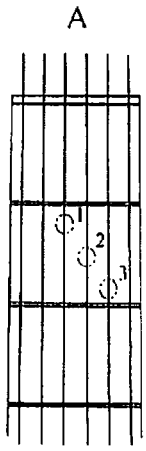
( PRIOR ART ) FIG. 16a
FIG. 16*a* is a schematic view showing the actual finger placement positions for A chord of prior art.

As described in the above embodiment, the at least one control button 1511 can open or switch the data of the finger placement positions for chords in different keys and select the data of the finger placement positions for a particular chord of a key from numerous keys. The control unit 151 controls the light-emitting units 154 corresponding to the data of the finger positions of the chord in that key to emit light (as shown in FIGS. 14 and 15). In this way, for the beginner, the leaning efficiency can be promoted without having to keep the chords in different keys in mind.

While the preferred embodiments have been described as above, it is noted that the preferred embodiments are not intended to restrict the scope of implementation of the present invention. Modifications and variations can be made without departing from the spirit and scope of the claims of the present invention.

What is claimed is:

1. A finger-pressed auxiliary device for a stringed instrument, the stringed instrument comprising a body, a neck connected to the body and having a top and a bottom, a fingerboard disposed on the neck, a plurality of frets disposed on the fingerboard at spaced intervals, and a plurality of strings extending along a length direction of the neck, the finger-pressed auxiliary device comprising:

a plurality of finger-pressed plates extending along the length direction of the neck, each being disposed to correspond to a respective string of the plurality of strings;

an upper support secured to the top of the neck; and a lower support secured to the bottom of the neck or the body, both ends of each of the finger-pressed plates being fixed by the upper support and the lower support, respectively, so that the finger-pressed plates are securely suspended above the strings, wherein when each of the finger-pressed plates is pressed, a bottom surface of the finger-pressed plate depresses a corresponding string against the fingerboard; and when the finger-pressed plate is not pressed, the finger-pressed plate does not touch the string.

2. The device of claim 1, wherein the bottom surface of each finger-pressed plate includes a plurality of transverse ribs; when each of the finger-pressed plates is pressed, the transverse ribs provided on the bottom surface of the finger-pressed plate depress a corresponding string against the fingerboard.

3. The device of claim 2, wherein the plurality of ribs of each finger-pressed plate are staggered with the plurality of frets.

4. The device of claim 2, wherein each rib is formed with a groove corresponding to a string.

5. The device of claim 1, wherein the width of each finger-pressed plate is two times larger than the diameter of the corresponding string.

6. The device of claim 5, wherein a top surface of each finger-pressed plate is planar, convex or concave.

7. The device of claim 1, wherein the plurality of finger-pressed plates are formed in one piece.

8. The device of claim 1, wherein the top surface of each finger-pressed plate is formed with a plurality of partitioning line corresponding to the plurality of frets.

9. The device of claim 1, wherein the upper support comprises a cross bar and a pair of support parts for supporting the cross bar at both ends so that a receiving space is formed between the pair of support parts, one end of each finger-pressed plate is received in the receiving space and securely attached to a bottom surface of the cross bar.

10. The device of claim 1, wherein the upper support comprises a nut block having one end fixed to the top of the neck laterally; a plurality of longitudinal grooves extending downwardly from a top of the nut block, and are disposed to correspond to the plurality of stings for receiving the strings so that a single string extends through each corresponding groove; and one other end formed of a protrusion inclined with respect to the direction in which the strings extends; wherein a plurality of longitudinal recesses spanning both sides of the grooves are disposed on the protrusions at positions corresponding to the plurality of grooves for supporting each finger-pressed plate.

11. The device of claim 1, wherein the lower support comprises a cross bar and a pair of support parts for supporting the cross bar at both ends so that a receiving space is formed between the pair of support parts, the other end of each finger-pressed plate is received in the receiving space and securely attached to a bottom surface of the cross bar.

12. The device of claim 1, wherein the lower support comprises an upper clamp having a cross-sectional shape of an inverted "U" and being adapted to dispose on the fingerboard, a lower clamp having a U-shaped cross-section, a clamping pate disposed on the fingerboard, and a stopping part having a limiting plate and a bolt, wherein the upper clamp comprises a connecting part provided at each end, and a supporting part provided on a bottom surface between both ends thereof for supporting the other ends of the plurality of finger-pressed plates in a suspension manner; the lower clamp is adapted to attach to the periphery of the neck, and includes a connecting part at each end thereof, the connecting parts of the lower clamp correspond to the connecting parts of the upper clamp; each end of the clamping plate is sandwiched between the connecting parts of the upper clamp and the connecting parts of the lower clamp, and the ends of the clamping plate, the connecting parts of the upper and lower clamps are fastened together; the limiting plate of the stopping part is located within the lower clamp and beneath the neck, the lower clamp is provided with a threaded hole through which one end of the bolt is extended to urge against the limiting plate, and the other end of the bolt is provided with a handle disposed externally of the lower clamp.

13. The device of claim 1, further comprising a light-emitting indicating device, wherein the light-emitting indicating device comprises a control unit and a plurality of light-emitting units electrically connected to the control unit, the light-emitting units being disposed on the specific finger placement positions of the finger-pressed plates, and the control unit controls the corresponding light-emitting units to emit light based on the data of the finger placement positions playing a chord or note.

14. The device of claim 13, wherein the light-emitting and indicating device further comprises a power module, a storage unit, and a data transmission module, the power module, the storage unit, and the data transmission module are electrically connected to the control unit, and an external device stores the data of the finger placement positions in the storage unit through the data transmission module.

* * * * *